US008256029B2

(12) United States Patent
Fujihana et al.

(10) Patent No.: US 8,256,029 B2
(45) Date of Patent: Sep. 4, 2012

(54) GLOVE

(75) Inventors: Terukazu Fujihana, Himeji (JP); Ryohei Yamamoto, Himeji (JP)

(73) Assignee: Showa Glove Co., Himeji-Shi (JP)

( * ) Notice: Subject to any disclaimer, the term of this patent is extended or adjusted under 35 U.S.C. 154(b) by 798 days.

(21) Appl. No.: 12/439,882

(22) PCT Filed: Aug. 30, 2007

(86) PCT No.: PCT/JP2007/066885

§ 371 (c)(1), (2), (4) Date: Mar. 4, 2009

(87) PCT Pub. No.: WO2008/029703

PCT Pub. Date: Mar. 13, 2008

(65) Prior Publication Data

US 2010/0050319 A1 Mar. 4, 2010

(30) Foreign Application Priority Data

Sep. 4, 2006 (JP) ..... 2006-238700

(51) Int. Cl.
*A41D 19/00* (2006.01)

(52) U.S. Cl. ..... 2/161.3; 2/161.6

(58) Field of Classification Search ..... 2/159, 161.1, 2/168, 161.2, 161.3, 161.6, 161.7, 161.8
See application file for complete search history.

(56) References Cited

U.S. PATENT DOCUMENTS

| | | | | |
|---|---|---|---|---|
| 4,143,109 | A * | 3/1979 | Stockum | 264/112 |
| 4,497,072 | A * | 2/1985 | Watanabe | 2/169 |
| 5,742,943 | A * | 4/1998 | Chen | 2/168 |
| 6,254,947 | B1 * | 7/2001 | Schaller | 428/36.8 |
| 6,582,788 | B2 * | 6/2003 | Yeh | 428/36.8 |
| 2008/0235850 | A1 * | 10/2008 | Cabauy et al. | 2/161.8 |
| 2008/0244809 | A1 * | 10/2008 | Hassan et al. | 2/161.8 |
| 2011/0265246 | A1 * | 11/2011 | Saito | 2/168 |

FOREIGN PATENT DOCUMENTS

| | | |
|---|---|---|
| JP | 1986-146802 | 7/1986 |
| JP | 1991-30219 | 3/1991 |
| JP | 6-33303 | 2/1994 |
| JP | 2001-40583 | 2/2001 |
| JP | 2001-146614 A1 | 5/2001 |
| JP | 2003-253566 A1 | 9/2003 |

OTHER PUBLICATIONS

International Search Report for International Application No. PCT/JP2007/066885 dated Sep. 13, 2007.

* cited by examiner

*Primary Examiner* — Danny Worrell
(74) *Attorney, Agent, or Firm* — Kratz, Quintos & Hanson, LLP

(57) ABSTRACT

A glove having a fiber glove coated and impregnated with a polyurethane resin that is superior in wearing/removing efficiency and grip property between the glove and thumb and fingers and also in strength and flexibility. The glove is superior in workability, strength, durability, and flexibility, as well as in waterproofness. The glove hasa fiber glove coated and impregnated with a polyurethane resin such that resin films or resin regions having an uneven surface like a knit or weave pattern of the yarn are formed on a partial or entire surface in the impregnated resin regions on the inside surface by the resin impregnated from the outside surface to the inside surface, and the dynamic friction coefficient of the inside surface of the glove having the resin films or resin regions is 0.8 to 1.8.

20 Claims, 3 Drawing Sheets

(a)

(b)

GLOVE

TECHNICAL FIELD

The present invention relates to a glove suitable for working or sporting, obtained by coating a polyurethane resin on a fiber glove.

BACKGROUND ART

Known are work gloves having a resin or rubber layer on a partial or entire surface, for example in a palm region, of a base fiber glove for improvement in slip resistance and waterproofness. In particular, polyurethane resin-coated work gloves, which are superior in a breathable property, have been used widely.

Work gloves carrying a polyurethane resin coating on a fiber glove are grouped into two types: a type in which the resin is impregnated in the glove and the other type in which the resin is not impregnated in the glove. The resin-impregnated gloves are high in the slip resistance of inside surface of glove and the grip property between the glove and a hand, but low in wearing/removing efficiency. For example, such a work glove can be prepared by using a seamless knitted glove as base glove, fitting the base fiber glove on a hand-shaped mold for processing, coating a polyurethane DMF (N,N-dimethylformamide) solution thereon, immersing the glove held on the hand-shaped mold in a water tank for displacement of DMF in the solvent with water, and thus, allowing precipitation of the polyurethane by loss of solubility and forming a polyurethane resin film on the base glove and drying. Favorably, the work glove prepared by the method described above has a porous region where DMF is displaced with water, and is thus superior in air permeability and resistant to slipping between the hand and the work glove because of the impregnated polyurethane resin, and also superior in workability of the glove and suited for fine processing because there is no seam in the areas corresponding to fingertips. However, because the polyurethane resin impregnates inward through the base glove to the area on the hand-shaped mold, the impregnated resin, as it plays a role for slip resistance, causes problems such as deterioration in wearing/removing efficiency and also in touch feeling because the resin layer becomes thicker.

Patent Document 1 discloses, as a work glove carrying a polyurethane resin coating in which the resin impregnation is prevented, a glove containing an impregnated polyurethane resin not impregnating to the inside surface of the glove that was prepared by impregnating the base glove sufficiently with water before immersion in DMF and thus, allowing precipitation of the coated polyurethane resin in the region close to the base glove surface, before it impregnates to the inside surface of the glove. The method demands tightness of stitches in the base glove and water keeping property similar to that of spun yarns, and the finished glove is superior in wearing/removing efficiency, but slipping between the glove and a hand occurs, disadvantageously leading to deterioration in workability or anti-slipping force. In addition, the fiber glove inevitably becomes thicker for keeping water content, and it is quite difficult to keep the water content uniformly, especially when the thickness of the fiber glove is 0.5 mm or less. The impregnated water often caused irregularity, for example in resin impregnation, disadvantageously leading to a problem of deterioration in appearance of the glove. In addition, the resin layer, which is thicker, has another problem of unfavorable touch feeling.

Alternatively, Patent Document 2 discloses a fabric prepared by impregnating the base fabric in water, coating a polyurethane solution thereon, and precipitating the polyurethane in the region close to the base fabric surface, and the polyurethane work glove prepared by using the same is superior in wearing/removing efficiency, but has problems that it is inferior in workability, because of slipping between the glove and a hand, and lower in anti-slipping force.

Yet alternatively, Patent Document 3 discloses a method comprising steps of mixing a solvent-based polyurethane solution and a water-dispersed polyurethane solution at a suitable rate, preparing a raw material of a polyurethane resin unstabilized in the mixture solution, fitting a fiber glove previously impregnated with water and ethanol on a hand-shaped mold for processing, immersing it in the prepared raw material, and allowing precipitation of the resin before its impregnation inward. The method eliminates the need for a step of solidifying the polyurethane resin by displacement of the polyurethane-dissolving solvent with water in the process for manufacturing polyurethane resin coated work gloves produced by wet coagulation. But disadvantageously, the raw material is lower in stability and the loss of the raw material is large, and the polyurethane film may be come off easily from the glove, if the raw material precipitates too early. In addition, it is difficult to control the water content in the fiber glove.

Yet alternatively, Patent Document 4 discloses a fabric resistant to polyurethane impregnation that is prepared by finishing of a base fabric with a fluorine-based water repellent, and the glove prepared by using the same is superior in wearing/removing efficiency, but causes slipping between the glove and a hand, disadvantageously leading to deterioration in workability. Expansion of stitches of the base glove leads to facilitated resin impregnation, but it is in particular difficult to fit the base fabric on a hand-shaped mold in a complicated shape such as of glove, while preventing the expansion of stitches. If the action of the fluorine-based water repellent is too effective, the polyurethane layer may be come off from the base fabric, while if the action of the fluorine-based water repellent is too weak, the polyurethane resin may impregnates the base fabric, and thus, it is difficult to control the processing with the fluorine-based water repellent, especially when the base fabric is smaller in thickness.

Patent Document 5 discloses a glove of a non-expandable knitted fabric having a polyurethane resin film laminated on its base fabric. The resin is not impregnated into the knitted fabric because it is produced by lamination processing. Gloves having a polyurethane region outside surface are superior in wearing/removing efficiency, but causes slipping between the glove and a hand, which leads to deterioration in workability, while those having the polyurethane region inside surface have a problem of difficulty in wearing and removing. The very thin resin layer is damaged easily and has a low adhesion strength between the resin layer and the base glove, disadvantageously causing a problem of facile coming off of the resin layer during use.

As described above, work gloves prepared by coating a polyurethane resin on a work glove of conventional fiber textile are divided into gloves having the resin completely impregnating to the inside surface and those having the resin not completely impregnating. Gloves having a polyurethane resin completely impregnating have a problem of unfavorable wearing/removing efficiency of glove because of the slip-resisting action of the resin, while gloves having the resin not completely impregnating have problems of slip of thumb and fingers in the glove and deterioration in workability.

Patent Document 1: JP-A No. 61-146802
Patent Document 2: JP-A No. 2001-3727199
Patent Document 3: JP-A No. 2001-3986223
Patent Document 4: JP-A No. 2003-253566
Patent Document 5: JP-A No. 6-33303

DISCLOSURE OF THE INVENTION

Problems to be Solved by the Invention

Accordingly, an object of the present invention, which was made under the circumstances described above, is to provide a glove having a fiber glove coated and impregnated with a polyurethane resin that is superior in wearing/removing efficiency and grip property between the glove and thumb and fingers and also in strength and flexibility. Another object is to provide a glove superior in workability, strength, durability, flexibility, as well as in waterproofness.

Means to Solve the Problems

After intensive studies, the inventors have found that a glove having a fiber glove coated and impregnated with a polyurethane resin characterized in that inpregnation of the resin to the entire inside surface of the glove is prohibited and the resin is allowed to impregnate onto the inside surface like the inside weave or knit pattern of the base glove satisfies the requirements in high workability, flexibility, and durability. They also found that such a glove having an additional non-porous layer formed on the surface satisfies the requirements in workability, reinforcement, flexibility and waterproofness.

Thus, the present invention relates to a glove having a fiber glove coated and impregnated with a polyurethane resin, characterized in that resin films or porous impregnated resin regions having uneven surface like a knit or weave pattern of the yarn are formed on a partial or entire surface in the impregnated resin regions on the inside surface by the resin impregnated from the outside surface to the inside surface, and the dynamic friction coefficient of the inside surface of the glove having the resin films or resin regions is 0.8 to 1.8. In the present invention, the value of the dynamic friction coefficient is calculated from the average frictional force obtained in the region of 10 to 25 cm, when a test piece cut off from the palm region of a resin-coated glove is drawn for a distance of 30 cm at a rate of 150 mm/min, under load of a friction block of 63.5×63.5 mm by contact area and 200 g by weight, on a polyvinyl chloride sheet placed horizontally, having a hardness of A80 (calculated according to JIS K6253 3.2(2) type A test) and a thickness of 5 mm or more.

The resin films or the resin regions described above are formed substantially like a surface shape in the patterned yarn region on the inside surface of the glove, and the resin films or the resin regions are formed discontinuously, as the resin is deposited over the surface of the patterned yarn region on the inside surface of the glove. Preferably, a non-porous coat layer is formed additionally on the outside surface of the glove with the coated polyurethane resin.

The present invention also relates to a glove having a fiber glove coated and impregnated with a polyurethane resin, characterized in that resin films or resin regions of the resin are formed substantially like a surface shape of the patterned yarn region on the inside surface of the glove on a partial or entire surface in the impregnated resin region on the inside surface by the resin impregnated from the outside surface to the inside surface, and a non-porous coat layer of the coated resin is formed on the outside surface of the glove.

The present invention further relates to a fiber glove coated and impregnated with a polyurethane resin, characterized in that resin films or resin regions of the resin are formed discontinuously as the resin is deposited over the surface of the patterned yarn region on the inside surface of the glove on a partial or entire surface in the impregnated resin region on the inside surface by the resin impregnated from the outside surface to the inside surface, and a non-porous coat layer of the coated resin is formed on the outside surface of the glove. Preferably in the glove described above, all or part of the polyurethane resin excluding the non-porous coat layer are porous like sponge.

The thickness of the coat layer is preferably 20 to 120 μm. The resin films or resin regions having uneven surface like a knit or weave pattern of the yarn are formed on the inside surface, as the polyurethane resin is coated by impregnation and then, the resin layer is dissolved with a solvent. When the base glove is made of a non-woven fabric, an irregular-surfaced resin-coated face in the fiber pattern of the non-woven fabric is formed. Particularly preferably in the glove described above, the polyurethane resin layer has a two-layer structure, and the resin films or resin regions having uneven surface like a knit or weave pattern of the yarn are formed on the inside surface, by forming the first layer by coating and impregnating, and then coating a second-layer resin material containing a solvent having a solubility parameter of 9 to 11 in an amount of 30 to 75% thereon, thus allowing dissolution of the first-layer resin layer.

Alternatively when the polyurethane resin layer has a single layer structure, the layer is formed by coating and impregnating a fiber glove with a polyurethane for wet processing improved in water displacement speed, and water displacement is followed. Alternatively when the polyurethane resin layer has a two-layer structure, the layer is formed by coating and impregnating the fiber glove with a polyurethane for wet processing improved in water displacement speed as the first-layer resin material, followed by water displacement, and coating the first layer with a polyurethane for dry processing as the second resin material. The polyurethane for wet processing is preferably a material containing a surfactant in an amount of 0.3 to 6 parts with respect to 100 parts of the polyurethane resin and thus improved in water displacement speed. In addition, the used polyurethane resin may be a breathable polyurethane resin.

Advantageous Effects of the Invention

Thus, the present invention provides a glove superior in wearing/removing efficiency and grip property between the glove and thumb and fingers as well as in flexibility and waterproofness, as the base glove is reinforced.

BRIEF DESCRIPTION OF THE DRAWINGS

FIG. 1(*b*) is an electron micrograph showing the cross section thereof.

BEST MODE OF CARRYING OUT THE INVENTION

Figure 1:
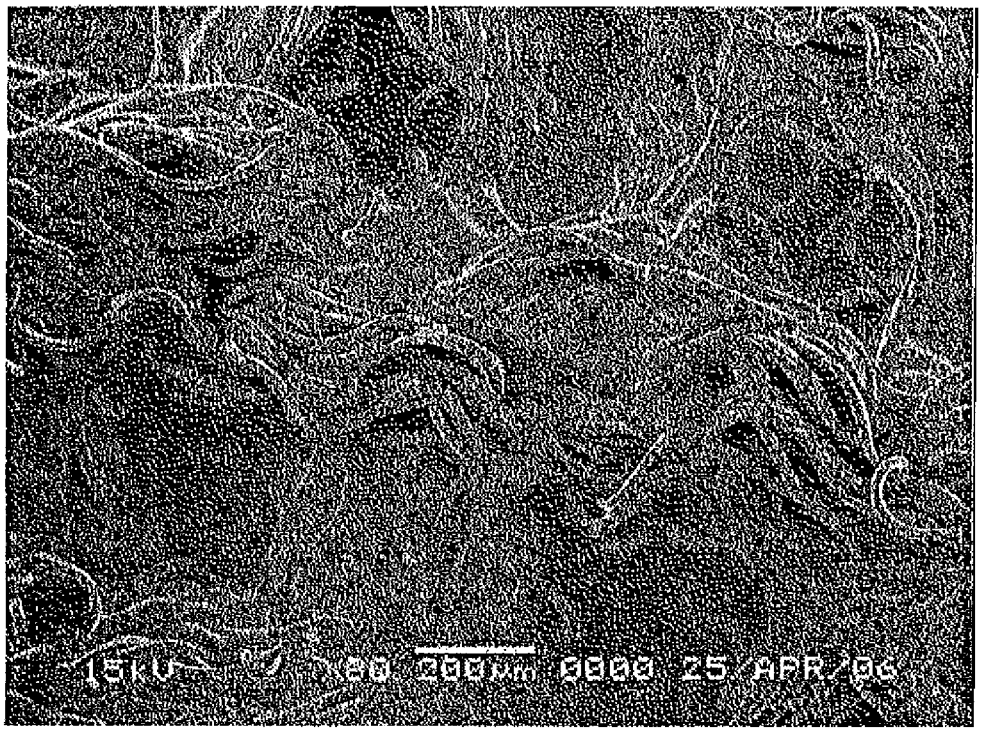
FIG. 1(*a*) is an electron micrograph showing the inside surface of the glove of Example 1.
Figure 1:
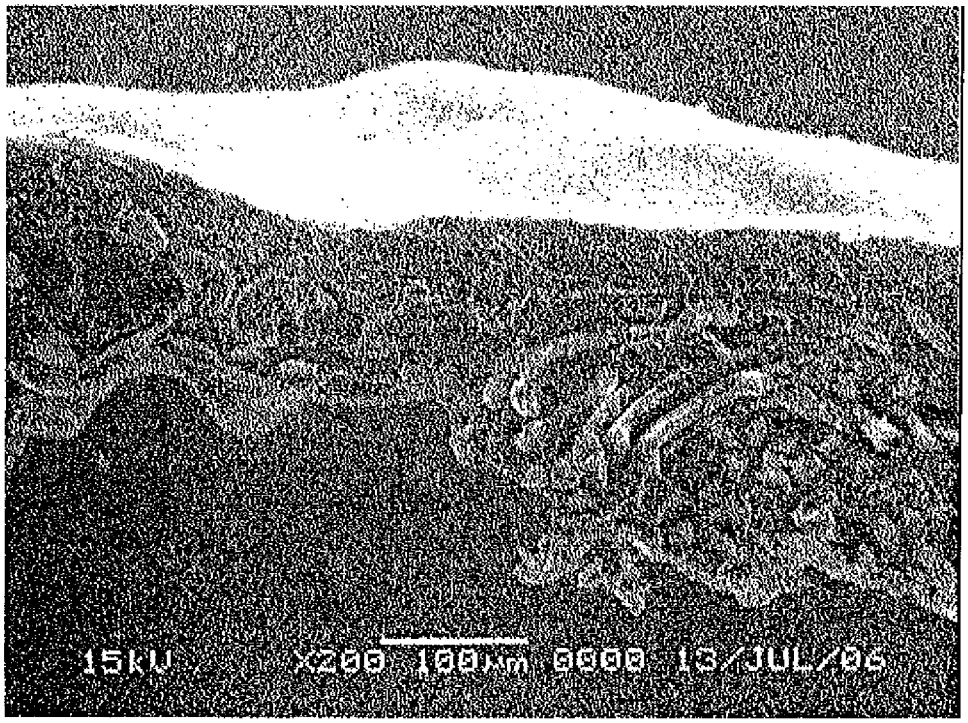

Hereinafter, embodiments of the present invention will be described.

In the glove according to the present invention, a polyurethane resin is coated on part or all of the base glove as it is impregnated therein; a resin layer is formed in the region close to the surface of the base glove; and resin films, resin-coated regions or porous impregnated resin regions having uneven surface like a knit or weave pattern of the yarn are formed on a partial or entire surface in the impregnated resin regions on the inside surface by the resin impregnated from the outside surface to the inside surface.

The base glove is a glove of multi filament yarn or spun yarn of a known synthetic fiber and/or a natural or regeneration fiber, and specifically, a sewn base glove of a fabric such as woven fabric or knitted fabric or a seamless knitted base glove may be used as the base glove. Because the workability of the glove is better when it has an expandable soft texture, use of a sewn base glove of knitted fabric or a seamless knitted base glove is preferable.

Examples of the natural fibers include cotton, wool, silk, hemp, and the like. Examples of the synthetic fibers include polyester-based fibers, polyamide-based fibers, acrylic fibers, polyvinyl chloride-based fibers, rayon fibers, polynosic fibers, cupra fibers, polyacetate fibers, polytriacetate fibers, premix fibers, vinylon fibers, polyvinylidene fibers, polypropylene fibers, polybenzoate fibers, polychlarl fibers, polyethylene fibers, polyaramide-based fibers, polyurethane fibers, and the like. Alternatively, rubber yarns such as of polyurethane rubber and natural rubbers may also be used.

The yarn may be used alone or in combination of two or more, according to application. For example, use of a high strength fiber is preferably for prevention of incision wound accident, and examples of the fiber for use include high-strength polyethylene fiber, para-phenylene terephthalamide fiber, and liquid-crystal high-strength polyarylate fibers. For prevention of dusts, for example in clean room application, a base glove of multi filament yarn such as of polyester-based fiber, polyamide-based fiber, rayon fiber, polynosic fiber, polyethylene fiber, or polyaramide-based fiber or the crimped yarn thereof is preferable.

The fineness of the yarn for the base glove may vary according to application, but preferably 40 to 1000 dtex. A yarn having a fineness of more than 1000 dtex may give a harder base glove unfavorable in texture, touch feeling, and softness.

In the case of a seamless knitted base glove, the knitting density thereof is preferably 10 gauge (hereinafter, indicated by "G") or more, more preferably 13 G or more, and more preferably 18 G or more, from the points of the texture, touch feeling and softness of the finished glove. A knitting density of less than 10 G tends to increase in fineness of the used yarn, giving a harder glove unfavorable in texture, touch feeling and softness.

In the case of a sewn base glove, for example of a knitted fabric, the thickness of the used textile is preferably less than 1 mm, more preferably less than 0.5 mm. A textile thickness of 1 mm or more leads to increase in the amount of the polyurethane resin impregnated in the yarn and thus, in the hardness of the finished glove. Alternatively, the relative tensile elongation in the wale direction (elongation along the direction of stitches of the surface), as calculated according to JIS L1096 8.12.1(A), is preferably 1.2 or more, with respect to 1 of that under no force applied. At a relative tensile elongation of less than 1.2, the finished glove is often harder, even if a highly flexible polyurethane resin is used for coating.

In the case of a knitted base glove, in the weft yarn, a stitch drawn ahead through the preceding stitch is called back stitch, while a stitch drawn backward through the preceding stitch for the next stitch is called face stitch (Encyclopedia of Fiber, Tatsuya Motomiya et al. Ed., Maruzen Co., Ltd.), and a glove having the face stitch on the outside surface is called front knit pattern, while a glove having the back stitch on the glove outside surface is called rear knit pattern. Independently of whether the pattern is front knit pattern or rear knit pattern, the pattern formed on the inside surface of glove is called inside pattern (e.g., back stitch in the case of front knit pattern), and the pattern on the outside surface of the glove is called outside pattern. The glove is preferably rear knit patterned, because the coating resin coats uniformly on the glove surface.

A resin layer is formed on the base glove outside surface region for example for slip resistance and improvement in reinforcement and waterproofness, but the resin layer formed on the base glove outside surface preferably holds part or all of the yarns in the outside pattern for prevention of coming off thereof from the base glove. There is no problem if there are some residual pores for applications that do not demand waterproofness. If the resin layer further impregnates and holds half or more of the inside patterned yarns, the glove may become harder, leading to increased tendency of contact between the hand and the resin layer and thus to deterioration in wearing/removing efficiency. It can be examined by micrographic observation of the glove cross section, and the resin layer preferably holds 3 to 100% of the cross section of the outside patterned yarns, more preferably 5 to 80%, still more preferably 8 to 60%, and particularly preferably 10 to 50%.

The thickness of the resin layer may be determined arbitrarily according to operational application. For example, for precision machining application, in which the touch feeling of thumb and fingers is important, the thickness of the resin layer is preferably smaller, while it is larger for protection from incision wound accident. An excessively thick resin layer leads to deterioration in workability and the impression of use, while an excessively thin resin layer may cause troubles such as of pinhole and coming off. Thus, the thickness is preferably 20 to 1000 μm, more preferably 30 to 600 μm, and still more preferably 40 to 200 μm.

Preferably, the resin film, resin-adhered regions or porous impregnated resin regions formed like the inside pattern on the inside surface of the base glove do not cover the inside patterned yarns of the base glove completely for prevention of deterioration in wearing/removing efficiency and are exposed to the inside of the base glove to a degree giving favorable slip resistance between hand and glove. In particular, the relationship between the inside pattern and the porous impregnated resin regions exposed to the inside is important and can be observed under microscope, and the wearing/removing efficiency and the slip resistance can be defined by its dynamic friction coefficient. A large dynamic friction coefficient may lead to deterioration in glove wearing/removing efficiency, while a small dynamic friction coefficient may lead to decrease in slip resistance between hand and glove and deterioration in workability. Thus, the dynamic friction coefficient is preferably 0.8 to 1.8, more preferably 1.0 to 1.7, and still more preferably 1.0 to 1.6.

The glove may be prepared, for example, by the method below, but the production method is not limited thereto. A base glove is fitted on a hand-shaped mold, immersed in and then taken up from a polyurethane solution for wet processing, and then treated in a water bath for precipitation of the polyurethane resin by displacement of the solvent with water. The precipitated polyurethane resin has pores in the regions where the solvent is displaced.

The inventors have found that it was possible to make the pores in porous layer larger and give a base glove containing the porous impregnated resin therein and carrying a film on the surface easily, by increasing the precipitation speed of the polyurethane resin solution. They also have found that, when the precipitated resin is dissolved with a solution once again, the porous polyurethane resin layer is dissolved to give a non-porous film-coated resin layer; the porous impregnated resin to the inside of the glove is absorbed in the non-porous film-like resin layer on the surface and the yarn region; and the polyurethane resin deposits discontinuously over the surface of the inside patterned yarns from the inside base glove, forming discontinuously resin films or resin regions substantially like the shape of the inside pattern. Generally, larger pores are likely to prohibit preservation of its porous layer when dissolved, and the layer is absorbed more easily into the resin layer or the yarn region. Polyurethane regions excluding polyurethane resin region in a non-porous film-shaped state preferably retain their sponge-like structure, even after dissolution, because the glove remains soft in this way.

Any known polyurethane resin solution may be used as the resin solution, and examples thereof include Crisvon (registered trade name) MP-812, Crisvon 8006HVLD, and Crisvon MP-802 (manufactured by Dainippon Ink and Chemicals Inc.); Sanprene (registered trade name) LQ-X 37L, Sanprene LQ-3358, and Sanprene LQ-3313 A (manufactured by Sanyo Chemical Industries, Ltd.); and RESAMINE (registered trade name) CU-4340, RESAMINE CU-4310HV, and RESAMINE CU-4210 (Dainichiseika Color & Chemicals Mfg. Co., Ltd). The polyurethane resin solution is preferably displaced with water at high speed, and the method of water displacement at high speed is for example to raise the temperature of the water used during displacement to 60 to 70° C., or to use a film-forming aid for a polyurethane for wet processing such as surfactant.

There are both silicone surfactants and non-silicone surfactants available, but silicone surfactants are preferable for acceleration of water displacement. The surfactant may be used in an amount of 0.3 to 6 parts with respect to 100 parts of the polyurethane resin, and an addition amount of less than 0.3 part may not be effective in raising the displacement speed, while an addition amount of more than 6 parts may lead to saturation of the acceleration in displacement speed. The addition amount is preferably 0.5 to 5.5 parts, more preferably 1 to 5 parts, and still more preferably 2 to 4 parts. Examples of the surfactants favorable for use include ASSISTOR SD-11 and ASSISTOR SD-7 (manufactured by Dainippon Ink and Chemicals Inc.), RESAMINE Cut-30 (manufactured by Dainichiseika Color & Chemicals Mfg. Co., Ltd), LUCKSKIN (registered trade name) JA-40, LUCKSKIN JA-70, and LUCKSKIN JA-110 (manufactured by Seikoh Chemicals Co., Ltd.), and the like.

The polyurethane resin solution can be diluted with any known suitable solvent. Examples thereof include N,N-dimethylformamide, N,N-dimethylacetamide, dimethylsulfoxide, N-methylpyrrolidone, hexamethylenephosphonamide, methylcellusolve, benzene, toluene, xylene, methylethylketone, methylpropylketone, methylbutylketone, ethylethylketone, ethylpropylketone, isopropyl alcohol, isobutyl alcohol, ethyl acetate, butyl acetate, chloroform, methylene chloride, dioxane, and the like. These solvents may be used alone or as a mixing.

The viscosity of the polyurethane resin raw material may be selected arbitrarily according to application. It is preferably 100 to 1000 mPa·S from the point of workability. The viscosity depends on the solid content concentration of the polyurethane resin solution, and the solid content concentration is small at a viscosity of less than 100 mPa·S, leading to generation of many pinholes in the formed resin layer, while a viscosity of more than 1000 mPa·S may lead to production of a film having a smaller amount of pores and of less flexible.

The polyurethane resin layers may be a single layer or a multi-layer composite film. For example if it has a two-layer structure, use of a solvent highly dissolving polyurethane for the second layer (having a solubility parameter of 9 to 11), such as DMF, methylethylketone, or methyl cellosolve, in an amount of 30 or more, preferably 30 to 75%, with respect to the total solvents leads to incorporation of the porous impregnated resin region into the resin layers or yarn regions on the surface of the glove and thus, to improvement in the balance between the wearing/removing efficiency of inside yarn region and the grip property between the hand and the glove on the inside surface.

Then the dissolved surface resin layer forms a non-porous coat film. The thickness of the non-porous coat film contributes to coating strength and glove flexibility. The thickness of the non-porous film, i.e., water-proof coat layer, is preferably 20 to 120 μm, more preferably 30 to 100 μm, and still more preferably 40 to 85 μm. A thickness of less than 20 μm leads to deterioration in film abrasion resistance and generation of pinholes, while a thickness of more than 120 μm leads to deterioration in glove flexibility. It is possible in this way to provide a glove which has a reinforced film and slip resistance property outside thereof superior in wearing/removing efficiency and grip property between the glove and a hand, and has high workability. It is also possible to thin the resin layer by dissolving the porous layer, and such a glove can be provided for use in precise machining application.

It is thus possible to provide a glove which has a reinforced film and slip resistance property outside thereof, superior in wearing/removing efficiency and grip property between the glove and a hand, and has high workability. It is also possible to thin the film and thus to provide such a glove for use in precise machining application. It is also possible to provide a glove with a favorable breathable property, by using a breathable polyurethane resin as the raw material.

EXAMPLES

Hereinafter, test results on the inside surface friction, wearing/removing efficiency, workability, flexing efficiency, film thickness, and film abrasion resistance of the gloves obtained in Examples 1 to 4 and Comparative Examples 1 to 3 will be described. It should be understood that the present invention is not restricted at all by these examples.

Example 1

A seamless nylon base glove at 13 G (knitting gauge) was fitted on a hand-shaped mold for processing; and the hand-shaped mold was immersed in and taken up from a solution of a polyurethane resin (product name: Crisvon MP812NB, manufactured by Dainippon Ink and Chemicals Inc.) previously diluted with DMF to a solid content concentration of 10% and added with 3 parts of a film-forming aid for a polyurethane for wet processing ASSISTOR SD-11 (manufactured by Dainippon Ink and Chemicals Inc.). It is then immersed in hot water at 60° C. for 20 minutes for displacement of the water-soluble organic solvent by water, for wet coagulation of the polyurethane with making pores. The hand-shaped mold was withdrawn from the water, dried by hot air, and then immersed in and withdrawn from a solution of a polyurethane resin (product name: Crisvon NYT-18, manufactured by Dainippon Ink and Chemicals Inc.) diluted with a solvent of DMF and xylene at 1:1 to a solid content concentration of 10%. The resin was dried by hot air at 120° C., and a desired glove was obtained after taking off from the hand-shaped mold.

Example 2

A glove was prepared in a similar manner to Example 1, except that the resin solution for the second layer was prepared by using a solvent containing IPA and xylene at a rate of 1:1.

Example 3

A glove was prepared in a similar manner to Example 1, except that the resin solution for the second layer was prepared by using a solvent containing DMF, MEK and xylene at a rate of 1:1:1.

Example 4

A glove was prepared in a similar manner to Example 1, except that the used glove was a 13 G knitted glove prepared by using a core yarn of polyurethane elastic fiber and a sheath wound yarn of an ultrahigh molecular weight polyethylene filament (trade name: Dyneema (registered trade name) SK60, manufactured by Toyobo Co., Ltd.).

Comparative Example 1

A glove was prepared in a similar manner to Example 1, except that the resin solution for the first layer was a polyurethane for wet processing that is slower in coagulation speed (Crisvon 8006HVLD, manufactured by Dainippon Ink and Chemicals Inc.) without adding any surfactant and the resin solution for the second layer was prepared with a dissolution solvent of IPA and xylene at 1:1.

Comparative Example 2

Patent Document 3 discloses a fabric prepared by impregnating a cotton base glove with water and coating a polyurethane solution thereon, while precipitating the polyurethane in the region close to the base fabric surface, as an example of a glove having no impregnated resin to the inside surface of the glove, and a polyurethane work glove prepared by using the same was used as the glove of Comparative Example 2. The used glove was "Dailove (registered trade name) 220" (manufactured by Dia Rubber Co., Ltd.).

Comparative Example 3

As an example of the glove having no impregnated resin to the inside surface of the glove, two of the sheets having a thin film laminated on a thin textile exemplified in Patent Document 6 were bonded to each other into a glove shape, and the glove was used as the sample of Comparative Example 3. Profecio (registered trade name) Non Seam Glove (manufactured by Goldwin Inc.) was used here for comparison.

(Dynamic Friction Coefficient)

A test piece cut off from the palm region of a resin-coated glove was drawn for a distance of 30 cm at a rate of 150 mm/min, under a load of 200 g friction block having a contact area of 63.5×63.5 mm, on a polyvinyl chloride sheet placed horizontally and the average frictional force in the region of 10 to 25 cm was used as the dynamic friction coefficient. The used polyvinyl chloride sheet had a hardness of A80 (as calculated according to JIS K6253 3.2(2) type A), which is similar to that of the human skin, and a thickness of 5 mm or more.

(Wearing/Removing Efficiency)

The wearing/removing efficiency of a glove was examined by ten examiners according to the following criteria: A: very good, B: good, C: normal, D: bad, and E: very bad, and the average was evaluated.

(Workability)

Slip between a glove and thumb and fingers was examined by ten examiners according to the following criteria: A: not slippy, B: hardly slippy, C: normal, D: slippy, and E: very slippy, and the average was evaluated.

(Flexing Efficiency)

The glove was flexed with thumb and fingers as it is worn by ten examiners, and the easiness of flexing was evaluated according to the following criteria: A: very good, B: good, C: normal, D: bad, and E: very bad, and the average was evaluated. The rate A indicates that the glove is softer so that it has good workability.

(Film Abrasion Resistance)

The test was performed by using a test instrument (Nu-Martindale, manufactured by James H. Heal & Co., Ltd.) according to CE test EN388. However, the polishing paper according to CE test EN388 was very rough, prohibiting comparison of film damage, and thus, a sand paper (dry & wet type) #2000 of relatively lower roughness manufactured by 3M was used. Film damage after abrasion for 100 times was examined by visual observation. A: there is no damage; B: there are damages of less than 1 mm; C: there are damages of 1 mm or more and less than 2 mm; D: there are damages of 2 mm or more and less than 3 mm; and E: there are damages of 3 mm or more.

The test results are summarized in the following Table 1.

TABLE 1

| | Dynamic friction coefficient (inside) | Wearing/ re-moving efficiency | Work-ability | Flexing effi-ciency | Film thick-ness | Film abrasion resis-tance |
|---|---|---|---|---|---|---|
| Example 1 | 1.36 | B | A | A | 0.07 mm | A |
| Example 2 | 1.50 | B | A | B | 0.10 mm | B |
| Example 3 | 1.30 | B | A | A | 0.07 mm | A |
| Example 4 | 1.38 | B | A | A | 0.07 mm | A |
| Compar-ative Example 1 | 2.13 | E | A | E | 0.70 mm | B |
| Compar-ative Example 2 | 0.64 | A | D | D | 0.23 mm | A |
| Compar-ative Example 3 | 0.57 | A | D | A | 0.03 mm | E |

The test results showed the following facts.

The glove of Example 1 is rated "A" in workability, indicating that the presence of the resin films or the resin regions on the inside surface is effective in eliminating slip of thumb and fingers in the glove and increasing workability. In addition, the wearing/removing efficiency was also very favorable, as it was rated "B", although it was not as favorable as those of Comparative Examples 2 and 3 having no resin film or resin region, indicating that the dynamic friction coefficient (inside) was favorably adjusted, because the resin films or the resin regions had an uneven surface like the yarn pattern. It was a very soft glove having a thin resin layer and a flexing efficiency rated "A". The abrasion resistance of the film was also high, as it was rated "A". It is because the first layer is resolved easily in DMF or MEK and the redissolved first resin is absorbed into the yarn.

The glove of Example 2 obtained was less slippery on the inside surface than that of Example 1, but the wearing/removing efficiency was favorable without problem, as rated "B", and grip property was favorable and the workability is better. However, the film strength was slightly lower, as rated "B". It is because both the solvents for dissolving the second resin, IPA and xylene, dissolves the first resin only slightly, and thus, insufficient redissolution of the first resin can not make a film because of leaving pores and not in the film as in Example 1.

The glove of Example 3 was slippery at a level similarly to Example 1, and the wearing/removing efficiency and the workability were favorable. The abrasion resistance of the film was also high as in Example 1.

The glove of Example 4 was slippery at a level similar to Example 1, and the wearing/removing efficiency and the workability were favorable. The resin thickness of the glove was small, and the glove was very flexible and soft. The abrasion resistance of the film was also high.

The glove of Comparative Example 1 had a high dynamic friction coefficient of 2.13, and the wearing/removing efficiency was very unfavorable at "E". The flexing efficiency was also unfavorable. It shows that, because the first resin impregnated into the glove significantly and the first layer was not redissolved by the solvent dissolving the second layer resin, the resin impregnated significantly to the inside surface of the obtained glove, thus affecting the wearing/removing efficiency and the flexing efficiency.

The glove of Comparative Example 2 was favorable in wearing/removing efficiency, but the glove was slippy and the workability was unfavorable. It is because no resin film or resin region was formed on the inside surface of the glove. In addition, the coat layer was thick, and the workability was unfavorable.

The glove of Comparative Example 3 was also favorable in wearing/removing efficiency, but the glove was slippy and the workability was unfavorable. In addition, the abrasion resistance was unfavorable at "E", indicating that the coat layer was easily come off.

FIGS. 1 to 4 are electron micrographs respectively showing the gloves of Example 1 and Comparative Examples 1 to 3.

As shown in FIG. 1(*a*), the resin forms films like the inside patterned yarns on the glove of Example 1, indicating that the favorably exposed inside pattern is a factor of improving the wearing/removing efficiency and providing the glove with favorable grip property between the glove and hand. As shown in the cross-sectional photograph (b), a non-porous resin layer is also formed on the glove surface.

Figure 2:
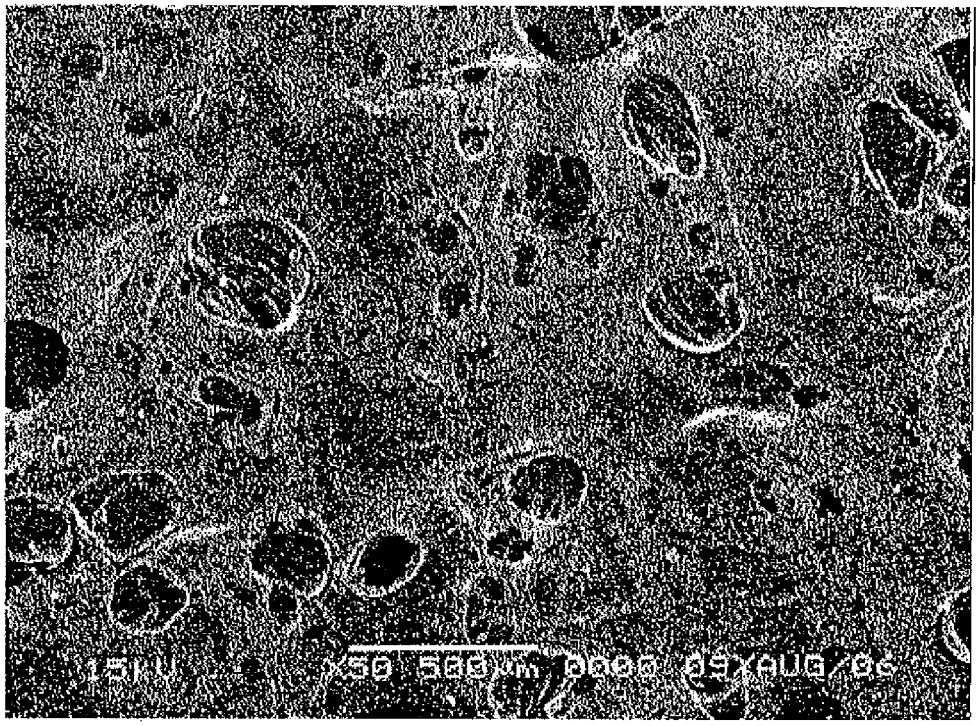
FIG. 2 is an electron micrograph showing the inside surface of the glove of Comparative Example 1.

As shown in FIG. 2, the resin impregnates the base glove so that it covers completely the inside surface of the glove of Comparative Example 1, leading to increase in the dynamic friction coefficient of the inside surface of the glove, which in turn leads to deterioration in wearing/removing efficiency.

Figure 3:
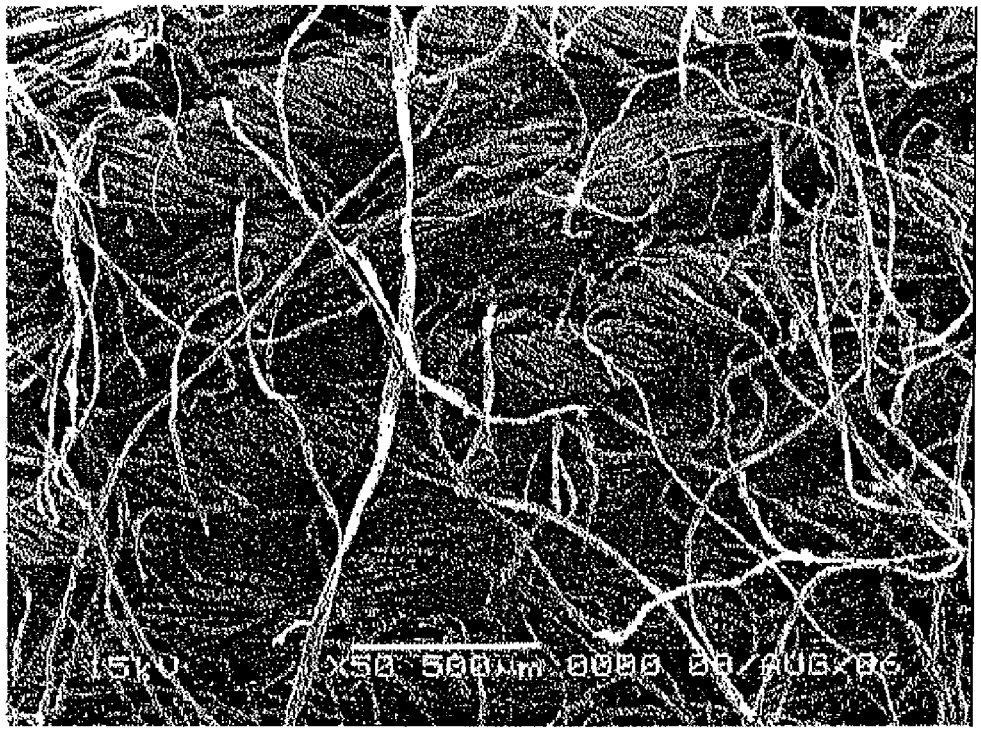
FIG. 3 is an electron micrograph showing the inside surface of the glove of Comparative Example 2.

As shown in FIG. 3, no resin impregnates the inside surface of the glove of Comparative Example 2, and for that reason, the wearing/removing efficiency is favorable but grip property between the glove and hand is unfavorable.

Figure 4:
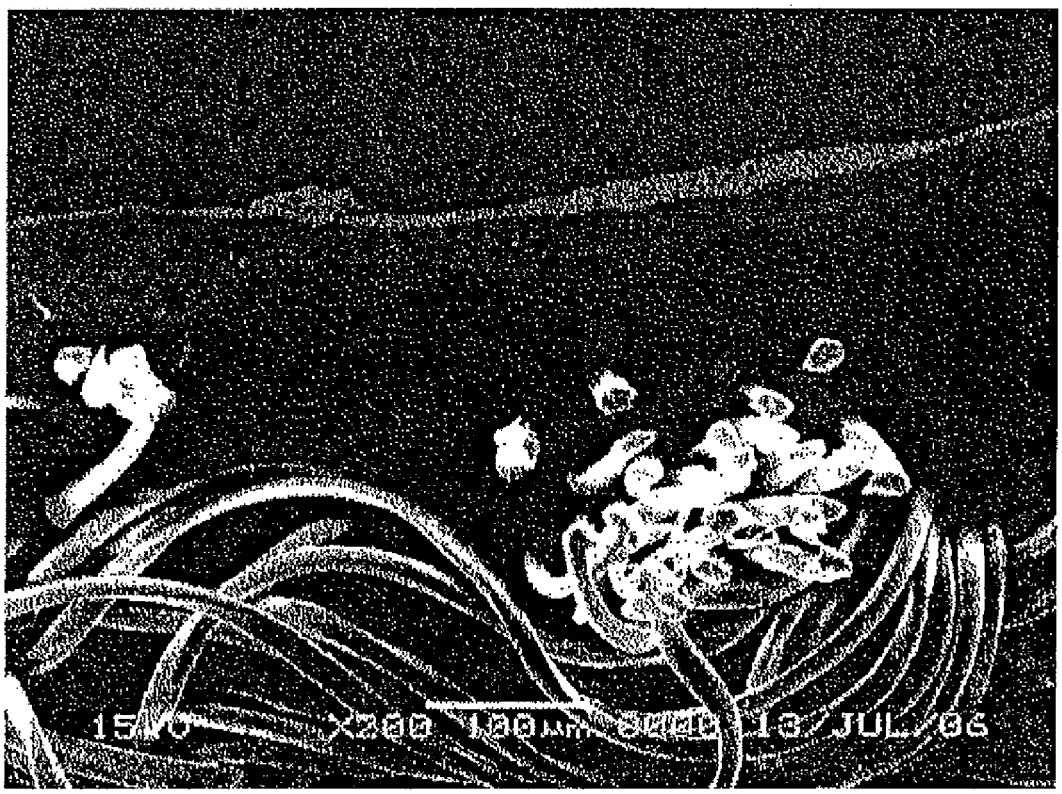
FIG. 4 is an electron micrograph showing the cross section of the glove of Comparative Example 3.

As shown in FIG. 4, on the glove of Comparative Example 3, the laminate film is not embedded into the yarn of the base glove, and thus, the glove has a very fragile structure, which leads to deterioration of the abrasion resistance of the glove.

Although the embodiments of the present invention have been described above, it should be understood that the present invention is not restricted at all by these Examples, and various modifications of the invention are possible within the scope of the present invention.

The invention claimed is:

1. A glove, with an inside surface and an outside surface, having a fiber glove of yarn coated and impregnated with a polyurethane resin, characterized in that resin films or porous impregnated resin regions having an uneven surface, in substantially a knit or weave pattern of the yarn, are formed on a partial or entire surface in the impregnated resin regions on the inside surface by the resin impregnated from the outside surface to the inside surface, and a dynamic friction coefficient of the inside surface of the glove having the resin films or resin regions is 0.8 to 1.8.

2. The glove according to claim l, wherein the resin films or resin regions are formed substantially in a surface shape of a patterned yarn region on the inside surface of the glove.

3. The glove according to claim 2, wherein the resin films or resin regions are formed discontinuously as the resin is deposited over the surface of the patterned yarn region on the inside surface of the glove.

4. The glove according to claim 3, wherein a non-porous coat layer is formed on the outside surface of the glove with the coated polyurethane resin.

5. A glove, with an inside surface and an outside surface, including a fiber glove of yarn coated and impregnated with a polyurethane resin, characterized in that resin films or resin regions of the resin are formed substantially in a surface shape of a patterned yarn region on the inside surface of the glove on a partial or entire surface in the impregnated resin region on the inside surface by the resin impregnated from the outside surface to the inside surface, and a non-porous coat layer of the coated resin is formed on the outside surface of the glove.

6. A glove, having an inside surface and an outside surface, including a fiber glove of yarn coated and impregnated with a polyurethane resin, characterized in that resin films or resin regions of the resin are formed discontinuously as the resin is deposited over the surface of a patterned yarn region on the inside surface of the glove on a partial or entire surface in the impregnated resin region on the inside surface by the resin impregnated from the outside surface to the inside surface, and a non-porous coat layer of the coated resin is formed on the outside surface of the glove.

7. The glove according to claim 6, wherein all or part of the polyurethane resin excluding the non-porous coat layer are porous.

8. The glove according to claim 7, wherein the thickness of the coat layer is 20 to 120 μm.

9. The glove according to claim 1, wherein the resin films or resin regions having uneven surface in a knit or weave pattern of the yarn are formed on the inside surface, as the polyurethane resin is coated by impregnation and the resin layer is dissolved with a solvent.

10. The glove according to claim 1, wherein the polyurethane resin has a two-layer structure; and the resin films or resin regions having uneven surfaces in substantially a knit or weave pattern of the yarn are formed on the inside surface, as a first layer is formed by coating and impregnation and then a second-layer resin material containing a solvent having a solubility parameter of 9 to 11 in an amount of 30 to 75% is coated thereon, thus allowing dissolution of the first-layer resin layer.

11. The glove according to claim 1, wherein the polyurethane resin has a single layer structure, and a polyurethane for wet processing improved in water displacement speed is coated and impregnated on the fiber glove, and water displacement is followed.

12. The glove according claim 1, wherein the polyurethane resin has a two-layer structure, and a polyurethane for wet processing improved in water displacement speed is coated and impregnated on the fiber glove as a first-layer resin material, followed by water displacement, and a polyurethane for dry processing is coated as a second resin material.

13. The glove according to claim 12, wherein the polyurethane for wet processing is a material containing a surfactant in an amount of 0.3 to 6 parts with respect to 100 parts of the polyurethane resin.

14. The glove according to claim 1, wherein the polyurethane resin, is a breathable polyurethane resin.

15. The glove according to claim 5, wherein the resin films or resin regions having uneven surface in substantially a knit or weave pattern of the yarn are formed on the inside surface, as the polyurethane resin is coated by impregnation and the resin layer is dissolved with a solvent.

16. The glove according to claim 6, wherein the resin films or resin regions having uneven surface in substantially a knit or weave pattern of the yarn are formed on the inside surface, as the polyurethane resin is coated by impregnation and the resin layer is dissolved with a solvent.

17. The glove according to claim 5, wherein the polyurethane resin has a two-layer structure; and the resin films or resin regions having uneven surfaces in substantially a knit or weave pattern of the yarn are formed on the inside surface, as a first layer is formed by coating and impregnation and then a second-layer resin material containing a solvent having a solubility parameter of 9 to 11 in an amount of 30 to 75% is coated thereon, thus allowing dissolution of the first-layer resin layer.

18. The glove according to claim 6, wherein the polyurethane resin has a two-layer structure; and the resin films or resin regions having uneven surfaces in substantially a knit or weave pattern of the yarn are formed on the inside surface, as a first layer is formed by coating and impregnation and then a second-layer resin material containing a solvent having a solubility parameter of 9 to 11 in an amount of 30 to 75% is coated thereon, thus allowing dissolution of the first-layer resin layer.

19. The glove according to claim 5, wherein the polyurethane resin has a single layer structure, and a polyurethane for wet processing improved in water displacement speed is coated and impregnated on the fiber glove, and water displacement is followed.

20. The glove according to claim 6, wherein the polyurethane resin has a single layer structure, and a polyurethane for wet processing improved in water displacement speed is coated and impregnated on the fiber glove, and water displacement is followed.

* * * * *